US007710334B2

(12) United States Patent
Noro et al.

(10) Patent No.: US 7,710,334 B2
(45) Date of Patent: May 4, 2010

(54) COMPLEX ANTENNA DEVICE

(75) Inventors: Junichi Noro, Akita (JP); Hisashi Takisawa, Akita (JP); Naoto Kondo, Akita (JP); Yuichi Saito, Akita (JP); Toshiaki Aizawa, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 297 days.

(21) Appl. No.: 11/829,337

(22) Filed: Jul. 27, 2007

(65) Prior Publication Data

US 2008/0055171 A1 Mar. 6, 2008

(30) Foreign Application Priority Data

Sep. 4, 2006 (JP) ..... P2006-238792

(51) Int. Cl.
*H01Q 1/32* (2006.01)

(52) U.S. Cl. ..... 343/715; 343/725

(58) Field of Classification Search ..... 343/713, 343/715, 725, 727
See application file for complete search history.

(56) References Cited

U.S. PATENT DOCUMENTS 2,539,433 A * 1/1951 Kandoian ..... 343/742
5,539,418 A * 7/1996 Egashira et al. ..... 343/712
6,031,496 A * 2/2000 Kuittinen et al. ..... 343/702
6,522,301 B2 * 2/2003 Takayama et al. ..... 343/709
6,646,606 B2 * 11/2003 Mikkola et al. ..... 343/700 MS
6,714,164 B2 * 3/2004 Shimizu ..... 343/715

FOREIGN PATENT DOCUMENTS

| | | |
|---|---|---|
| JP | 8-335824 | 12/1996 |
| JP | 10-093327 | 4/1998 |
| JP | 10-107542 | 4/1998 |
| JP | 2003-309411 | 10/2003 |

* cited by examiner

*Primary Examiner*—Tho G Phan
(74) *Attorney, Agent, or Firm*—Whitham Curtis Christofferson & Cook, PC

(57) ABSTRACT

A complex antenna device includes: an antenna base having a main surface and first and second ends opposed to each other; a bar antenna including a metal body and disposed upright on a side of the first end of the antenna base; at least one planar antenna mounted on the main surface of the antenna base between the first and second ends of the antenna base; a metallic member provided on a side of the second end of the antenna base so as to substantially remove physical influence of the bar antenna on the planar antenna.

14 Claims, 8 Drawing Sheets

Elevation Angle : 20deg(Sat)

Elevation Angle : 25deg(Sat)

Elevation Angle : 30deg(Sat)

Elevation Angle : 40deg(Sat)

Elevation Angle : 50deg(Sat)

Elevation Angle : 60deg(Sat)

COMPLEX ANTENNA DEVICE

BACKGROUND

1. Technical Field

The present invention relates to a complex antenna device, and more particularly, to a complex antenna device in which a planar antenna and a bar antenna are combined.

2. Related Art

Currently, as known in this technical field, various antennas are mounted on a vehicle such as an automobile. As such an antenna, for example, an antenna for a GPS (Global Positioning System), an antenna for an SDARS (satellite digital audio radio service), an antenna for a radio telephone, or an antenna for AM/FM radio is used.

The GPS (Global Positioning System) is a satellite positioning system using artificial satellites. In the GPS system, electric waves (GPS signal) are received from four artificial satellites (hereinafter, referred to as "GPS satellite") among twenty four GPS satellites orbiting around the earth, a positional relation and a time error between a mobile object and the GPS satellites are measured on the basis of the received electric waves, and a position or an altitude of the mobile object on a map is calculated with high precision on the basis of triangulation.

Recently, the GPS is used for a car navigation system detecting a position of a driving automobile and comes into wide use. The car navigation device includes a GPS antenna for receiving a GPS signal, a processor for detecting a present position of a vehicle by processing the GPS signal received by the GPS antenna, a displayer for displaying the position detected by the processor on a map, and the like. A planar antenna such as a patch antenna is used as the GPS antenna.

A rod antenna (bar antenna) is known as a 3-wave sharing antenna capable of receiving a radio telephone band, an FM radio band, and an AM radio band. The bar antenna is used as the radio telephone antenna or the AM/FM radio antenna. The bar antenna is made of metal. A multi-frequency antenna capable of receiving 4 waves of the radio telephone band, the FM radio band, the AM radio band, and a GPS band was proposed (e.g., see Patent Document 1). In the multi-frequency antenna disclosed in Patent Document 1, since a matching board is disposed upright on the base and an antenna element is inclined to the perpendicular line, a GPS satellite has a low elevation angle. However, the low elevation angle of the GPS satellite does not have a bad influence on the GPS antenna.

In addition, there was proposed a complex antenna in which a patch antenna capable of receiving a circular-polarized wave from the GPS satellite or the like and a rod antenna capable of sending and receiving a linearly-polarized wave used in a mobile telephone or the like are disposed in parallel to be a unit (e.g., see Patent Document 2). In the complex antenna disclosed in Patent Document 2, a direction of the power feeding patch relative to the rod antenna is set so that the short axis is substantially perpendicular to a plane that includes an intersection point of the short axis and a long axis of the power feeding patch of the patch antenna and an axis line of the rod antenna. Accordingly, it is suppressed that the electric wave radiated from the rod antenna has a bad influence on the adjacent patch antenna.

Further, an antenna device which is capable of receiving an electric wave signal radiated from a satellite and a terrestrial wave signal radiated from a terrestrial antenna and is suitable for a vehicle was proposed (e.g., see Patent Document 3). In the antenna device disclosed in Patent Document 3, a planar antenna is provided upwardly on a surface of a board and, a base end of an antenna element including a helical antenna departs from the planar antenna laterally, and a front end of the antenna element is inclined by about 30° about the vertical direction in the departing direction.

There is provided a 3-wave sharing antenna device in which an AM/FM receiving antenna capable of an AM broadcasting wave and an FM broadcasting wave and a GPS receiving antenna capable of receiving a GPS broadcasting wave are integrated with each other (e.g., see Patent Document 4).

The SDARS (Satellite Digital Audio Radio Service) is a digital broadcasting service using a satellite (hereinafter, referred to as "SDARS satellite") in the United States. That is, in the United States, a digital radio receiver receiving a satellite wave or a terrestrial wave from the SDARS satellite to provide digital radio broadcasting has been developed and put in practical use. Currently, in the United States, two broadcasting stations of XM and Sirius have provided radio programs more than total 250 channels throughout the whole country. The digital radio receiver is generally mounted in a mobile object such as an automobile, receives the electric wave in the frequency band of about 2.3 GHz, and provides the radio broadcasting. That is, the digital radio receiver is a radio receiver capable of providing the mobile broadcasting. Since the frequency of the reception electric wave is about 2.3 GHz, the reception wavelength (resonance wavelength) $\lambda$ at that time is about 128.3 mm. The terrestrial wave is formed in the manner that the satellite wave is received by an earth station, the frequency of the received satellite wave is slightly shifted, and the wave is re-sent in a linearly-polarized wave. That is, the satellite wave is a circular-polarized wave, but the terrestrial wave is a linearly-polarized wave. In addition, the planar antenna such as the patch antenna is used as the SDARS antenna.

The antenna device for XM satellite radio receives the circular-polarized electric wave from two geostationary satellites, and receives the electric wave by using terrestrial linear-polarized equipments in a blind zone. On the other hand, the antenna device for Sirius satellite radio receives the circular-polarized electric wave from three orbiting satellites (synchro type), and receives the electric wave by the use of the terrestrial linear-polarized equipments in the blind zone.

Since the electric wave in the frequency band of about 2.3 GHz is used in such digital radio broadcasting, an antenna device receiving the electric wave is required to be installed outdoors. Accordingly, when the digital radio receiver is mounted in a mobile object such as an automobile, the antenna device is required to be mounted on the roof of the mobile object.

Patent Document 1: JP-A-10-93327

Patent Document 2: JP-A-2003-309411

Patent Document 3: JP-A-10-107542

Patent Document 4: JP-A-8-335824

As described above, various complex antenna devices including plural kinds of antennas are known. In addition to the 3-wave sharing antenna (bar antenna) as the complex antenna device, it is conceivable that a planar antenna such as an SDARS antenna and a GPS antenna is mounted on a main surface of an antenna base. That is, a complex antenna in which a planar antenna and a bar antenna are combined is conceivable. However, in such a complex antenna, a ripple increases due to directivity (horizontal-plane directivity) of the planar antenna by physical influence of the bar antenna made of metal. That is, deterioration in ripple performance occurs due to the low elevation-angle property of the planar antenna. In other words, the bar antenna made of metal acts as a metallic obstacle when viewed from the planar antenna.

SUMMARY

An advantage of some aspects of the invention is to provide a complex antenna device capable of removing physical influence of a bar antenna on a planar antenna. The advantage can be attained by at least one of the following aspects:

According to a first aspect of the invention, there is provided a complex antenna device (10; 10A; 10B) comprising: an antenna base (20; 20A) having a main surface (20*a*) and first and second ends (20*b*, 20*c*) opposed to each other; a bar antenna (30) including a metal body (31) disposed upright on a side of the first end of the antenna base (20; 20A); at least one planar antenna (40, 50; 50A) mounted on the main surface of the antenna base between the first and second ends of the antenna base; a metallic member (70; 70A; 70B) provided on a side of the second end of the antenna base so as to substantially remove physical influence of the bar antenna (30) on the planar antenna (50; 50A).

In the complex antenna device (10) of the invention, the metallic member may include a metallic rod (70) disposed upright on the main surface (20*a*) of the antenna base. The complex antenna device (10A) may include a top case made of resin and covering the bar antenna (30) and the planar antenna (40, 50) in cooperation with the antenna base (20). In this case, the metallic member may include a metallic tape (70A) attached onto an inner wall (64*a*) of the top case. The complex antenna device (10B) may include a top case (20A) made of resin and covering the bar antenna and the planar antenna (50A) in cooperation with the antenna base (20A) made of metal. In this case, the metallic member (70B) may include a screw boss of the antenna base disposed upright so as to attach the antenna base (20A) to the top case (60A). In addition, the metallic member (70B) may further include a metallic screw (74) penetrating the screw boss (72).

In the complex antenna device (10; 10A; 10B) of the invention, the bar antenna (30) may be an antenna adapted to receive electric waves of AM/FM radio bands. Instead, the bar antenna (30) may be an antenna adapted to send and receive an electric wave for a car phone. The planar antenna (50; 50A) may be an SDARS antenna adapted to receive an electric wave from an SDARS satellite. In addition, the at least one planar antennas may include a first planar antenna (40) adapted to receive an electric wave from a first satellite, and a second planar antenna (50) adapted to receive an electric wave from a second satellite. The first planar antenna (40) may be a GPS antenna adapted to receive an electric wave from a GPS satellite as the first satellite and the second planar antenna (50) may be an SDARS antenna adapted to receive an electric wave from an SDARS satellite as the second satellite. The GPS antenna (40) may be provided at a position close to the bar antenna and the SDARS antenna (50) may be provided at a position close to the metallic member (70; 70A).

According to a second aspect of the invention, there is provided a complex antenna device comprising: an antenna base (20; 20A); a bar antenna (30) made of metal; at least one planar antenna (40, 50; 50A) mounted on the antenna base; a metallic member (70; 70A; 70B) made of metal, wherein the at least one planar antenna (40, 50; 50A) is positioned between the bar antenna (30) and the metallic member (70; 70A; 70B) so as to substantially remove physical influence of the bar antenna (30) on the planar antenna (40, 50; 50A).

In the complex antenna device (10) of the invention, the metallic member (70; 70A; 70B) includes a metallic rod (70) disposed upright on the antenna base.

In the complex antenna device (10) of the invention, the metallic member (70; 70A; 70B) includes a metallic tape (70A) attached onto an inner wall of the antenna device (10).

Reference numerals in the parentheses are given to easily understand the invention, but are not limited thereto.

In the invention, since a metallic member is disposed on a side opposite to a bar antenna with a planar antenna interposed therebetween, physical influence of the bar antenna on the planar antenna can be removed.

BRIEF DESCRIPTION OF THE DRAWINGS

The invention will be described with reference to the accompanying drawings, wherein like numbers reference like elements.

FIGS. 1(A) and 1(B) are diagrams illustrating a complex antenna device according to a first exemplary embodiment of the invention, in which FIG. 1(A) is a perspective view of a top case of the complex antenna device as obliquely viewed from the lower side and FIG. 1(B) is a perspective view of the complex antenna device with the top case detached therefrom, as obliquely viewed from the upper side.

FIGS. 2(A) to 2(F) are diagrams illustrating a directive property of an SDARS antenna in the complex antenna device (the improved product) according to the invention with a metallic rod shown in FIG. 1 and a directive property of an SDARS antenna in the known complex antenna device (the known product) without a metallic rod, and further illustrating directivity of an SDARS antenna in a case where a satellite wave from the SDARS satellite is received when the elevation angle of the SDARS satellite is in the range of 20° to 60°, in which FIG. 2(A) shows directivity when the elevation angle is 20°, FIG. 2(B) shows directivity when the elevation angle is 25°, FIG. 2(C) shows directivity when the elevation angle is 30°, FIG. 2(D) shows directivity when the elevation angle is 40°, FIG. 2(E) shows directivity when the elevation angle is 50°, and FIG. 2(F) shows directivity when the elevation angle is 60°.

FIGS. 4(A) and 4(B) are diagrams illustrating a complex antenna device according to a second exemplary embodiment of the invention, in which FIG. 4(A) is a perspective view of a top case of the complex antenna device as obliquely viewed from the lower side and FIG. 4(B) is a perspective view of the complex antenna device with the top case detached, as obliquely viewed from the upper side.

DESCRIPTION OF EXEMPLARY EMBODIMENTS

Hereinafter, exemplary embodiments of the invention will be described in detail with reference to the drawings.

Figure 1A:
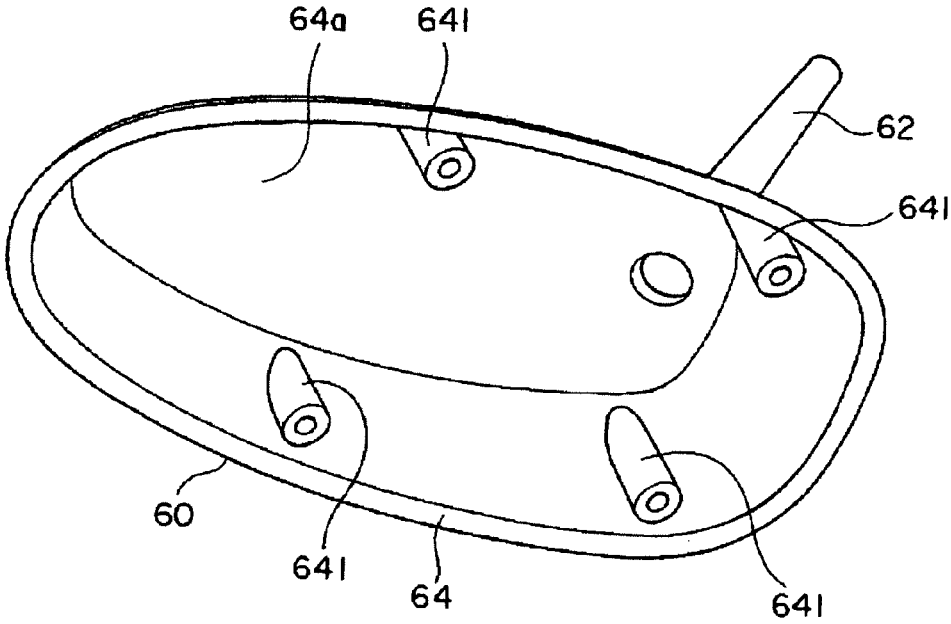
Figure 1B:
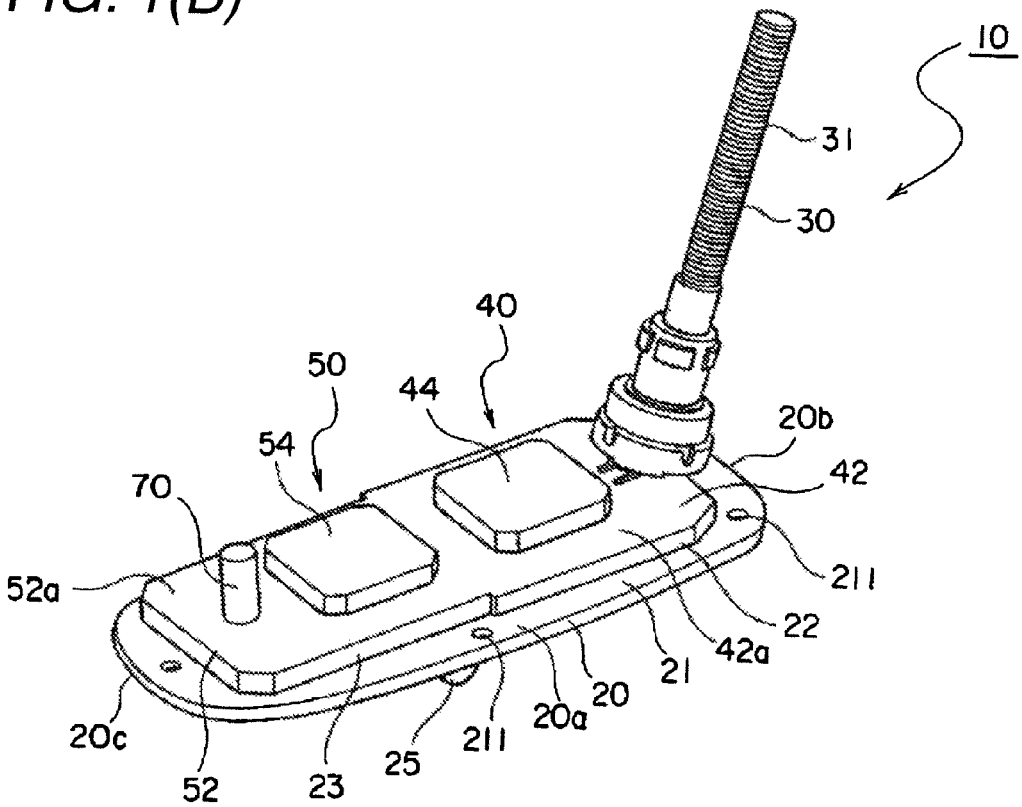
Figure 2A:
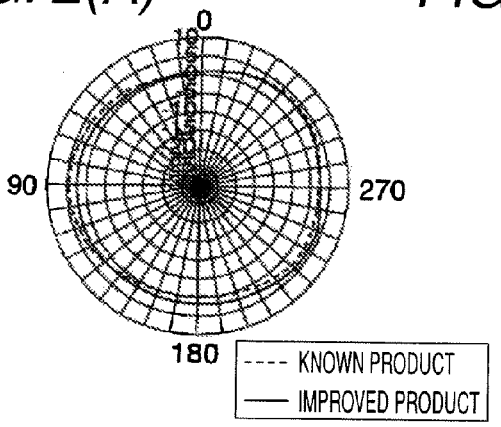
Figure 2B:
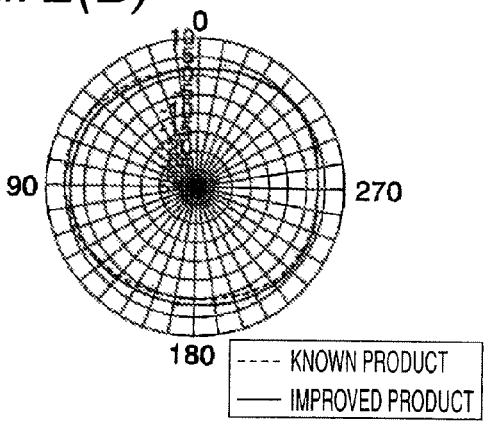
Figure 2C:
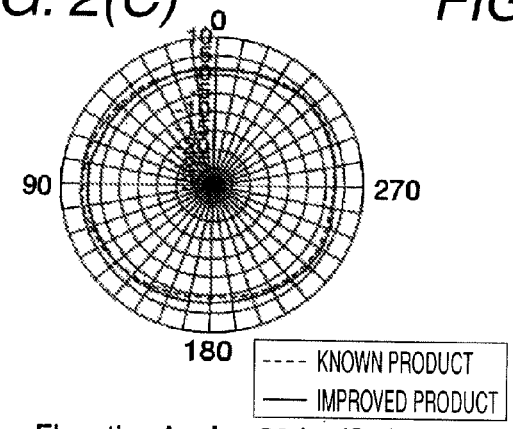
Figure 2D:
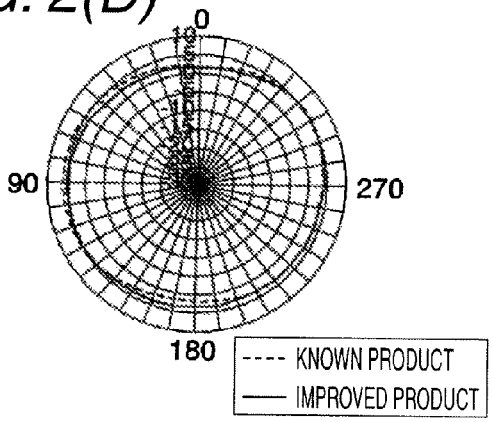
Figure 2E:
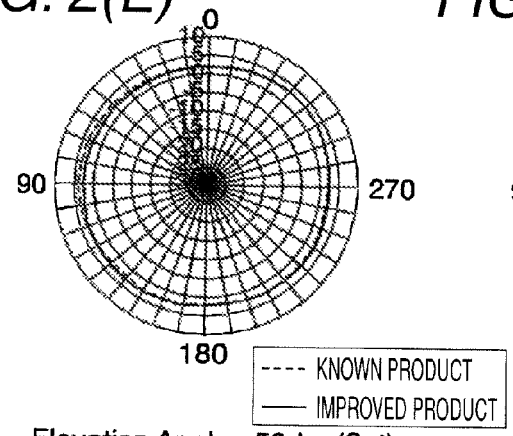
Figure 2F:
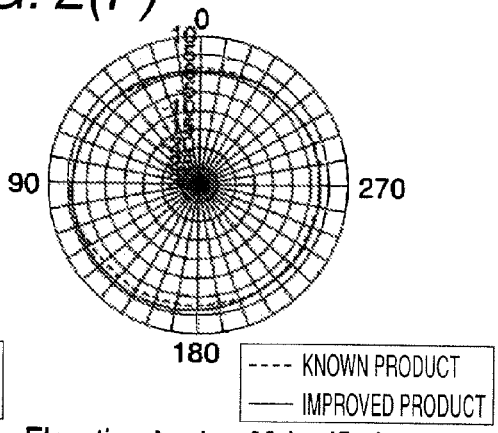

A complex antenna 10 according to a first exemplary embodiment of the invention will be described with reference to FIG. 1. FIG. 1(A) is a perspective view of a top case 60 of the antenna device 10, as obliquely viewed from the lower side. FIG. 1(B) is a perspective view of a complex antenna device 10 with the top case 60 detached therefrom, as obliquely viewed from the upper side.

The complex antenna device 10 includes an antenna base 20, a bar antenna 30, a first planar 40, a second planar antenna 50, and a top case 60 made of resin.

The antenna base 20 is made of die-casting materials such as zinc, aluminum, and magnesium. The antenna base 20 has a main surface 20*a*, and a first end 20*b* and a second end 20*c* opposed to each other. The antenna base 20 has a substantially flat base portion 21 and first and second shield walls 22 and 23 formed on an upper surface (main surface 20*a*) of the base portion 21. The base portion 21 and the first and second shield walls 22 and 23 are integrally formed. The first shield wall 22 is provided to shield a first low noise amplifier (LNA) circuit constituting a first planar antenna 40. The second shield wall 23 is provided to shield a second low noise amplifier (LNA) circuit constituting a second planar antenna 50. Although not shown in FIG. 1(B), a shield wall is further formed between the first shield wall 22 and the second shield wall 23.

The bar antenna 30 is disposed upright at the first end 20*b* of the antenna base 20 and includes a metal 31. A front end of the bar antenna 30 is provided obliquely in a direction departing from the first and second planar antennas 40 and 50. In the exemplary embodiment, the bar antenna 30 serves as an antenna for receiving electric waves of the AM/FM radio bands. In addition, the bar antenna 30 may serve as an antenna for receiving an electric wave used for a car phone or may serve as an antenna for receiving both of the electric waves of the AM/FM radio bands and the electric wave used for the car phone.

The first and second planar antennas 40 and 50 are mounted on the main surface 20*a* of the antenna base 20 between the first and second ends 20*b* and 20*c* of the antenna base 20. The first planar antenna 40 serves as an antenna for receiving an electric wave from a first satellite. The second planar antenna 50 serves as an antenna for receiving an electric wave from a second satellite. In the exemplary embodiment, the first planar antenna 40 serves as a GPS antenna receiving an electric wave from a GPS satellite as the first satellite. The second planar antenna 50 serves as an SDARS antenna receiving an electric wave from an SDARS satellite as the second satellite.

Specifically, the first planar antenna 40 includes a first circuit board 42 having a main surface 42*a* and a rear surface (not shown) opposed to each other, a first planar antenna element 44 mounted on the main surface 42*a* of the first circuit board 42, and a first LNA circuit (not shown) mounted on the rear surface of the first circuit board 42. The first planar antenna element 44 serves as an element for receiving an electric wave from the first satellite (GPS satellite). In the exemplary embodiment, the first antenna element 44 includes a patch antenna. The first LNA circuit is a circuit for amplifying a signal received by the first planar antenna element 44. AS shown in FIG. 1(B), the first circuit board 42 is mounted on the first shield wall 22. The first LNA circuit is shielded by the first shield wall 22.

Similarly, the second planar antenna 50 includes a second circuit board 52 having a main surface 52*a* and a rear surface (not shown) opposed to each other, a second planar antenna element 54 mounted on the main surface 52*a* of the second circuit board 52, and a second LNA circuit (not shown) mounted on the rear surface of the second circuit board 52. The second planar antenna element 54 serves as an element for receiving an electric wave from the second satellite (SDARS satellite). In the exemplary embodiment, the second antenna element 54 includes a patch antenna. The second LNA circuit is a circuit for amplifying a signal received by the second planar antenna element 54. As shown in FIG. 1(B), the second circuit board 52 is mounted on the second shield wall 23. The second LNA circuit is shielded by the second shield wall 23.

The top case 60 serves as a case for covering the bar antenna 30 and the first and second antennas 40 and 50 in cooperation with the antenna base 20. The top case 60 includes a cylindrical bar antenna cover 62 covering the bar antenna 30 and a cup-shaped upper case 64 covering the first and second planar antennas 40 and 50. The upper case 64 has four screw bosses 641 protruding downwardly from an inner wall 64*a* thereof at four portions.

Meanwhile, in the base portion 21 of the antenna base 20, four holes 211 (only two holes are shown in FIG. 1(B)) are formed at positions corresponding to the four screw bosses 641, respectively. The top case 60 is mounted on the antenna base 20 by fitting four screws (not shown) through the four holes 211 and the four screw bosses 641.

Although not shown in FIG. 1(B), a hole is formed at the center, in which the first and second shield walls 22 and 23 of the antenna base 20 come in contact with each other, of the base portion 21 of the antenna base 20. A bolt post 25 protruding downwardly from the base portion 21 is formed in the base portion 21 of the antenna base 21 at the position where the hole is formed. The hole and the bolt post 25 bind three output cables (not shown) drawn from the base portion of the bar antenna 30 and the first and second circuit boards 42 and 52.

Although not shown in FIG. 1, the antenna base 20 is mounted on a base pad.

In the first exemplary embodiment of the invention, the complex antenna device 10 includes a metallic member 70 provided at the second end 20*c* of the antenna base 20. The GPS antenna 40 is provided close to the bar antenna 30 and the SDARS antenna 50 is provided close to the metallic member 70.

As known in this technical field, the GPS antenna 40 preferably receive an electric wave from the GPS satellite about once per 5 seconds. On the other hand, the SDARS antenna 50 is required to constantly receive an electric wave from the SDARS satellite. For this reason, the SDARS antenna 50 requires a better directivity than that of the GPS antenna 40.

The metallic member 70 is provided at a specific position and has a size, so as to substantially remove physical influence of the bar antenna 30 on the second planar antenna (SDARS antenna) 50. If the size of the metallic member 70 is so small, it can not remove the physical influence. Accordingly, a predetermined size is needed for removing the physical influence. In the exemplary embodiment, the metallic member 70 is formed of a metallic rod disposed upright at the specific position on the main surface 20. In this manner, the metallic rod 70 is disposed upright at the opposite side to the bar antenna 30, with the first and second antennas 40 and 50 interposed therebetween, thereby improving directivity of the second planar antenna (SDARS antenna) 50. The metallic rod 70 may be preferably provided to extend up to adjacent to or higher than receiving plates of the first and second antennas 40 and 50 so as to remove physical influence of the bar antenna 30 further effectively.

Figure 3:
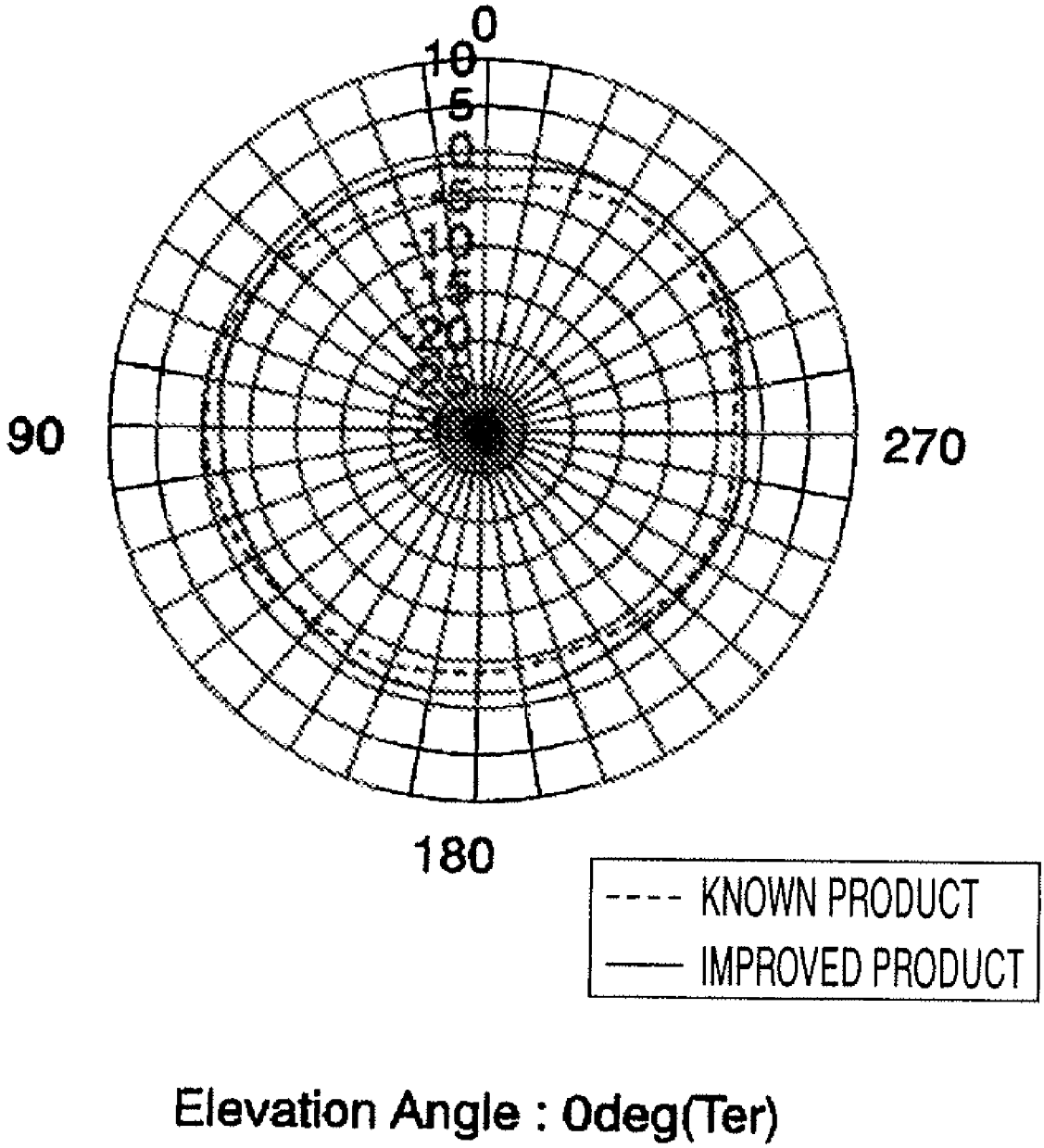
FIG. 3 is a diagram illustrating a directive property of an SDARS antenna in the complex antenna device (the improved product) according to the invention with a metallic rod shown in FIG. 1 and a directive property of an SDARS antenna in the known complex antenna device (the known product) without a metallic rod, and further illustrating directivity of an SDARS antenna in a case where a satellite wave from the SDARS satellite is received when the elevation angle is 0°.

In FIGS. 2 and 3, there are shown a directive property of the second planar antenna (SDARS antenna) 50 in the complex antenna device 10 (the improved product) according to the invention with the metallic rod 70 shown in FIG. 1 and a directive property of the second planar antenna (SDARS antenna) 50 in the known complex antenna device (the known product) without the metallic rod 70.

FIG. 2 is a diagram illustrating directivity of the second planar antenna (SDARS antenna) 50 in a case where a satellite wave from the SDARS satellite is received when the elevation angle of the SDARS satellite is in the range of 20° to 60°. FIG. 2(A) shows directivity when the elevation angle is 20°, FIG. 2(B) shows directivity when the elevation angle is 25°, FIG. 2(C) shows directivity when the elevation angle is 30°, FIG. 2(D) shows directivity when the elevation angle is 40°, FIG. 2(E) shows directivity when the elevation angle is 50°, and FIG. 2(B) shows directivity when the elevation angle is 60°.

FIG. 3 is a diagram illustrating directivity of the second planar antenna (SDARS antenna) 50 in a case where a satellite wave from the SDARS satellite is received when the elevation angle is 0°.

As known in this technical field, the more it is close to the perfect circle (i.e., the more roundness is high), the more a ripple of the directivity is small and good. It can be appreciated from FIGS. 2 and 3 that the directivity of the improved product is closer to the perfect circle than that of the known product (i.e., roundness is high) and is more improved than that of the known product.

Figure 4A:
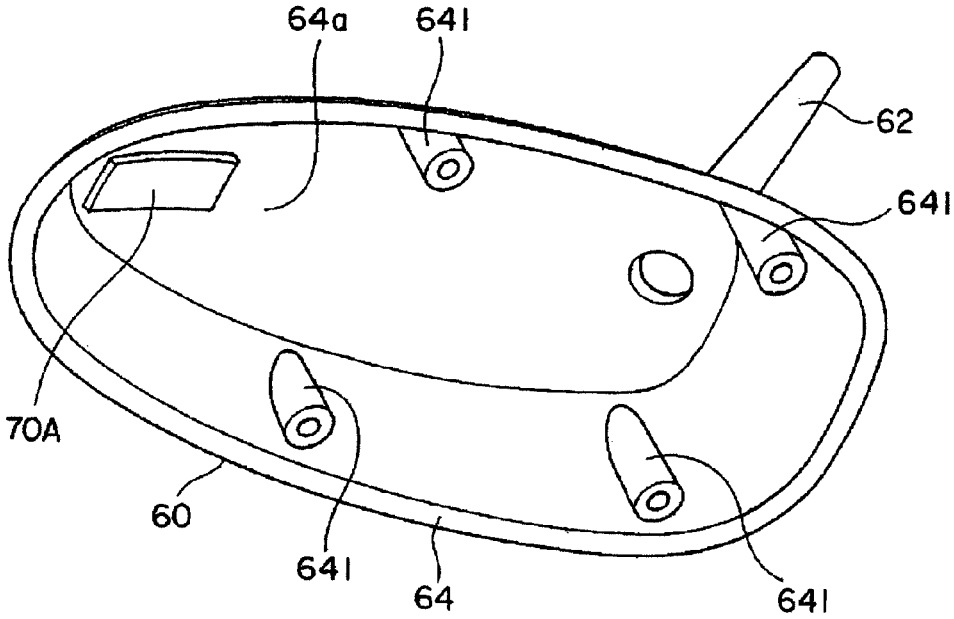
Figure 4B:
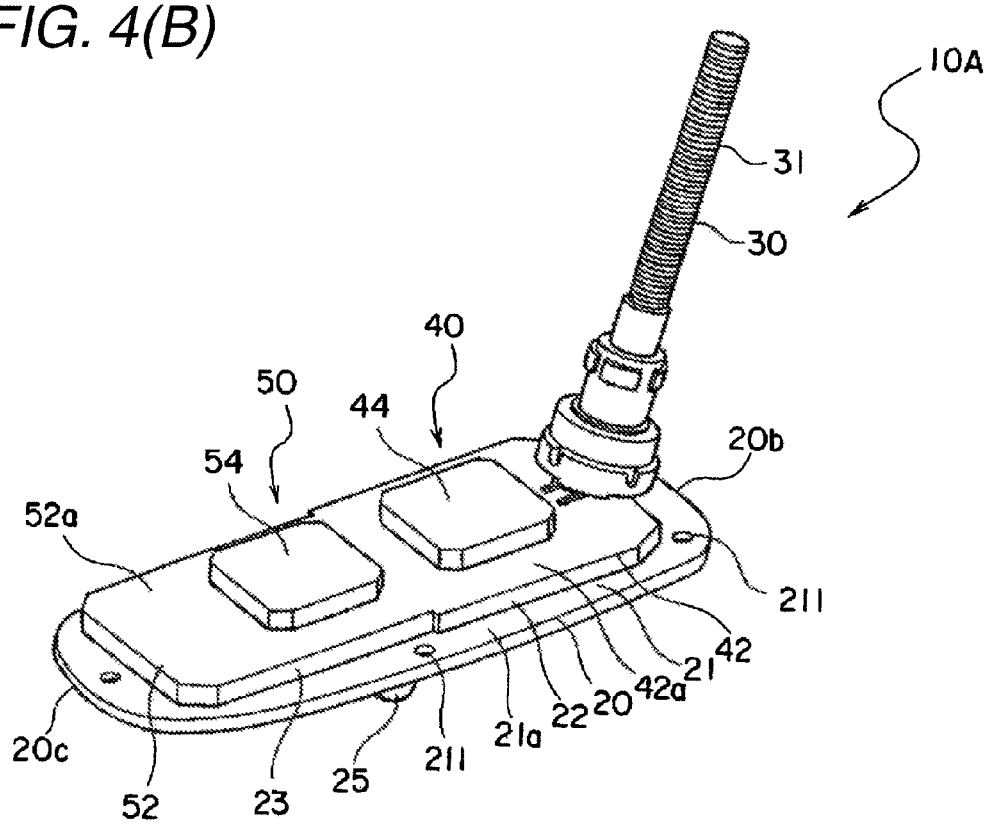

A complex antenna device 10A according to a second exemplary embodiment of the invention will be described with reference to FIG. 4. FIG. 4(A) is a perspective view of a top case 60 of the complex antenna device 10A, as obliquely viewed from the lower side. FIG. 4(B) is a perspective view of the complex antenna device 10A with the top case 60 detached therefrom, as obliquely viewed from the upper side.

The complex antenna device 10A has the same configuration as the complex antenna device 10 shown in FIG. 1, except that a configuration of the metallic member is different as described below. Accordingly, reference numeral 70A is given to the metallic member. The same reference numerals are given to what have the same function shown in FIG. 1. In order to simplify description (in order to avoid duplication of description), the description about the same constituent elements will be omitted.

The metal member 70A includes a metallic tape attached to a specific position in the inner wall 64*a* of the upper case 64 of the top case 60.

The inventors confirmed that the directivity was improved in the complex antenna device 10A with such a configuration as well as the complex antenna device 10 shown in FIG. 1 in comparison with the known complex antenna device.

In the exemplary embodiments shown in FIGS. 1 to 4, although there are provided two planar antennas of the first planar antenna (GPS antenna) 40 and the second planar antenna (SDARS antenna) 50, the complex antenna device according to the invention is applicable to a complex antenna device including only one planar antenna as the second planar antenna (SDARS antenna) 50, exclusive of the first planar antenna (GPS antenna) 40.

Figure 5:
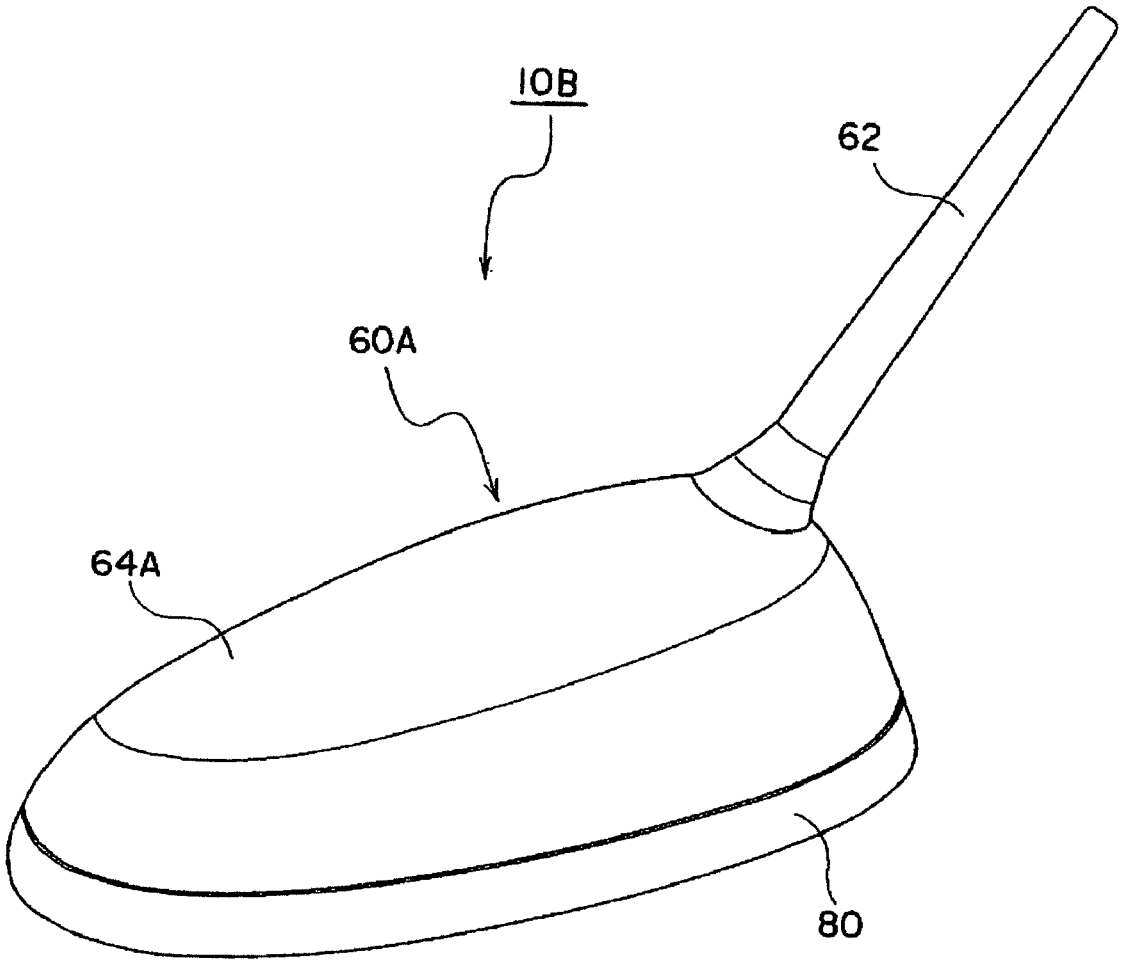
FIG. 5 is a perspective view of a complex antenna device according to a third exemplary embodiment of the invention as viewed from the upper side.
Figure 6:
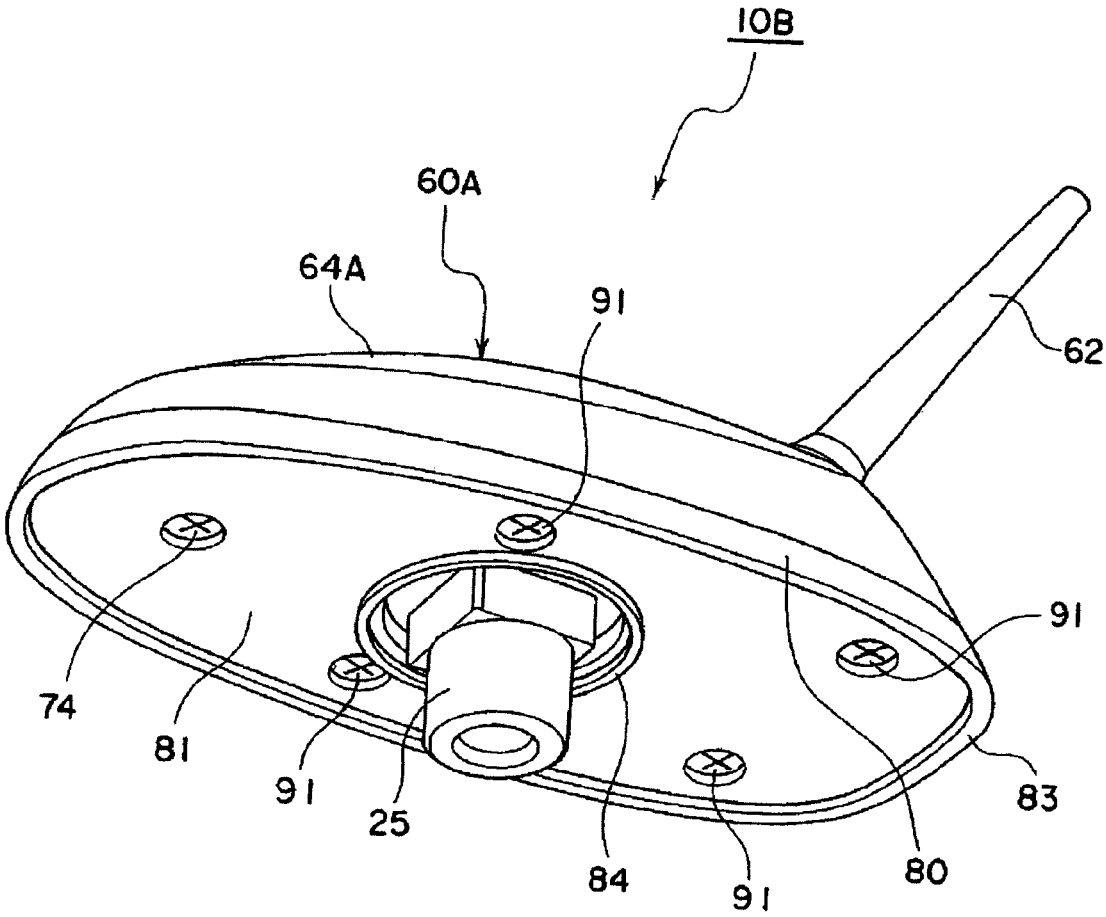
FIG. 6 is a perspective view of the complex antenna device shown in FIG. 5 as viewed from the lower side.
Figure 7:
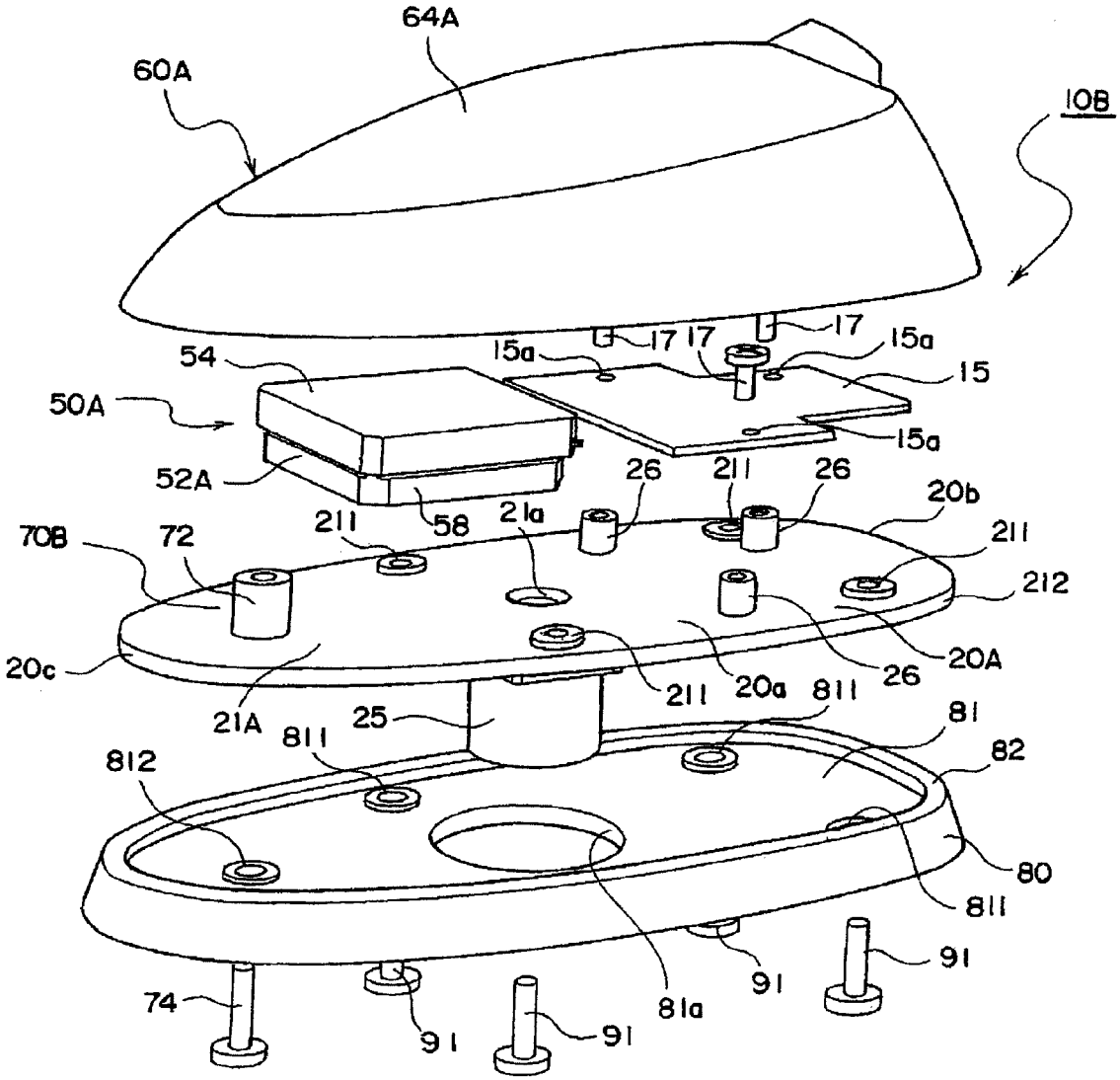
FIG. 7 is an exploded perspective view of the complex antenna device shown in FIG. 5 with the antenna cover detached therefrom.
Figure 8:
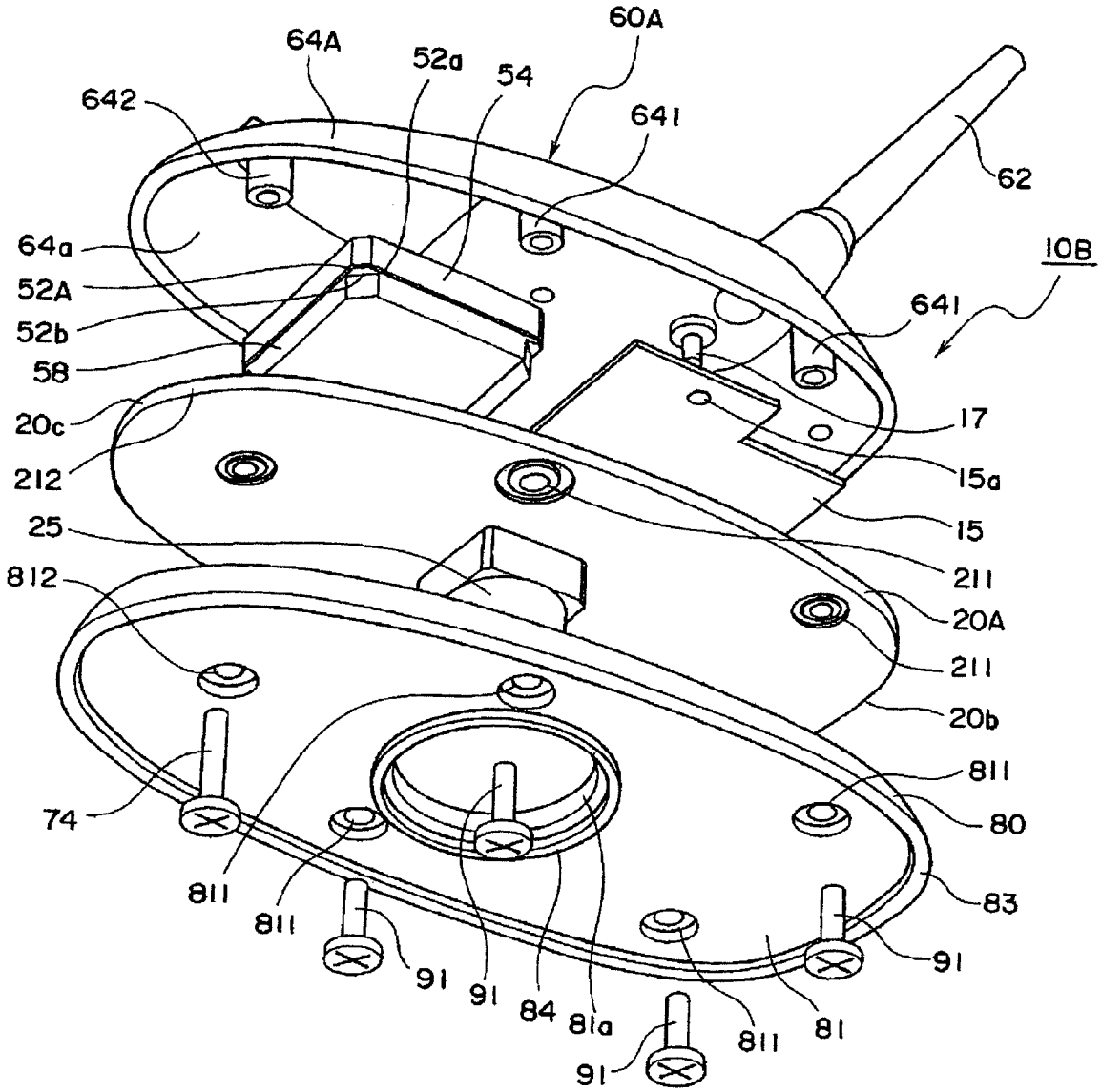
FIG. 8 is an exploded perspective view of the complex antenna device shown in FIG. 5 as viewed from the lower side.

Next, a complex antenna device 10B according to a third exemplary embodiment of the invention will be described with reference to FIGS. 5 to 8. FIG. 5 is a perspective view of the complex antenna device 10B as viewed from the upper side. FIG. 6 is a perspective view of the complex antenna device 10B as viewed from the lower side. FIG. 7 is an exploded perspective view of the complex antenna device 10B with the bar antenna cover 62 detached, as viewed from the upper side. FIG. 8 is an exploded perspective view of the complex antenna device 10B as viewed from the lower side.

The complex antenna device 10B is largely different from the above-described complex antenna devices 10 and 10A, in that the complex antenna device 10B includes only one planar antenna device 50A. Accordingly, the same reference numerals are given to what have the same function as the complex antenna device 10 shown in FIG. 1. Hereinafter, in order to simplify description, only parts different from the complex antenna device 10 will be described.

The complex antenna device 10B includes an antenna base 20A, a bar antenna (not shown), a planar antenna 50A, a top case 60A made of resin, and a base pad 80.

The antenna base 20A is made of die-casting materials such as zinc, aluminum, and magnesium. The antenna base 20A has a main surface 20*a* and a first end 20*b* and a second end 20*c* opposed to each other. The antenna base 20A has a substantially flat base portion 21A. The antenna base 20A has three screw bosses 26 protruding upwardly from the main surface 20*a* at the first end 20*b*. A circuit board 15 is mounted on the three screw bosses 26. The circuit board 15 has three holes 15*a* corresponding to the three screw bosses 26. Three screws 17 are fitted into the three screw bosses 26 through the three holes 15*a*, thereby fixing the circuit board 15 on the three screw bosses 26.

A base portion of the bar antenna (not shown) is mounted on the circuit board 15. The bar antenna is provided at the first end 20*b* of the antenna base 20A. The bar antenna includes a metal (not shown). The bar antenna is provided so that a front end thereof is inclined in a direction departing from the planar antenna 50A. In the exemplary embodiment, the bar antenna serves as an antenna for receiving electric waves of AM/FM radio bands. In addition, the bar antenna may serve as an antenna for receiving an electric wave used for a car phone or may serve as an antenna for receiving both of the electric waves of the AM/FM radio bands and the electric wave used for the car phone.

The planar antenna 50A is mounted on the main surface 20*a* of the antenna base 20A between the first and second ends 20*b* and 20*c* of the antenna base 20A. The planar antenna 50A is an SDARS antenna receiving an electric wave from an SDARS satellite.

The planar antenna 50A includes a circuit board 52A having a main surface 52*a* and a rear surface 52*b* opposed to each other, a planar antenna element 54 mounted on the main surface 52*a* of the circuit board 52A, an LNA circuit (not shown) mounted on the rear surface 52*b* of the circuit board 52A, and a shield case 58 shielding the LNA circuit. The planar antenna element 54 serves as an element for receiving an electric wave from an SDARS satellite. In the exemplary embodiment, the planar antenna element 54 includes a patch antenna element. The LNA circuit serves as a circuit for amplifying the signal received by the planar antenna element 54.

The top case 60A is a case for covering the bar antenna and the planar antenna 50A in cooperation with the antenna base 20A. The top case 60A includes the cylindrical antenna cover 62 covering the bar antenna and a cup-shaped upper case 64A covering the planar antenna 50A and the circuit board 15. The upper case 64A has four screw bosses 641 protruding downwardly from the corresponding four portions from the inner wall 64*a*.

In the base portion 21A of the antenna base 20A, four holes 211 are formed at the positions corresponding to the four screw bosses 641.

The base bad 80 is made of elastic resin. The base pad 80 includes an installation portion 81 on which the antenna base 20A is mounted, a ring-shaped wall portion 82 protruding upwardly in an outer periphery of the installation portion 81, a skirt portion 83 protruding downwardly in the outer periphery of the installation portion 81, a ring-shaped pad portion 84 protruding downwardly from the installation portion 81 in the vicinity of a circular opening 81*a* formed at the center of the installation portion 81. In the installation portion 81 of the base pad 80, four holes 811 are formed at the positions corresponding to the four holes 211 of the antenna base 20A, respectively.

The four screws 91 are fitted through the four holes 811 of the installation portion 81 of the base pad 80, the four holes 211 of the base portion 21A of the antenna base 20A, and the four screw bosses 641 of the upper case 64A of the top case 60A. Accordingly, the top case 60A is mounted on the antenna base 20A.

In a state where the ring-shaped wall portion 82 of the base pad 80 is fitted to an outer peripheral portion 212, the base pad 80 is mounted on the antenna base 20A. The skirt portion 83 and the ring-shaped pad portion 84 of the base pad 80 come in close contact with a vehicle body to seal a space between the vehicle body and the base pad 80. That is, the skirt portion 83 of the base pad 80 has a waterproof function and does not damage the exterior of the vehicle body. The ring-shaped pad 84 has a waterproof function.

A hole 21 is formed in the center of the base portion 21A of the antenna base 20A. In the center in which the hole 21*a* is formed, a cylindrical bolt post portion 25 protruding downwardly from the base portion 21A is formed in the base portion 21A of the antenna base 20A. The hole 21*a* and the bolt post portion 25 bind output cables (not shown) drawn from the circuit boards 15 and 52.

In the third exemplary embodiment of the invention, the complex antenna device 10B includes a metallic member 70B provided at the second end 20*c* of the antenna base 20A.

Specifically, the upper case 64A of the top case 60A has one screw boss 642 protruding downwardly from the inner wall 64*a* thereof at specific position. Meanwhile, the base portion 21A of the antenna base 20A has a screw boss 72 at the position (at the specific position) corresponding to the one screw boss 642 so as to mount the antenna base 20A on the top case 60A. In the installation portion of the base pad 80, one hole 812 is formed at the position corresponding to the screw boss 72 of the antenna base 20A.

The one metallic screws 74 is fitted through the one hole 812 of the installation portion 81 of the base pad 80, the screw boss 72 of the base portion 21A of the antenna base 20A, and the one screw boss 642 of the upper case 64A of the top case 60A. Accordingly, the top case 60A is also mounted on the antenna base 20A.

That is, the metallic member 70B includes the screw boss 72 of the antenna base 20A and the metallic screw 74 penetrating the screw boss 72.

As described above, the metallic member 70B is disposed upright at the side opposite to the bar antenna, thereby improving the directivity of the planar antenna (SDARS antenna) 50A.

While the exemplary embodiments of the invention have been described above, the invention is not limited to the above-described exemplary embodiments. In the third exemplary embodiment of the invention, the metallic member 70B includes the combination of the screw boss 72 and the metallic screw 74. However, when the screw 74 is made of resin, for example, the metallic member 70B may include only the screw boss 72.

The entire disclosure of Japanese Patent Application No 2006-238792, filed on Sep. 4, 2006 is expressly incorporated by reference herein.

While this invention has been described in conjunction with the specific embodiments thereof, it is evident that many alternatives, modifications, and variations will be apparent to those skilled in the art. Accordingly, exemplary embodiments of the invention as set forth herein are intended to be illustrative, not limiting. There are changes that may be made without departing from the sprit and scope of the invention.

What is claimed is:

1. A complex antenna device comprising:

an antenna base having a main surface and first and second ends opposed to each other;

a bar antenna including a metal body and disposed upright on a side of the first end of the antenna base;

at least one planar antenna mounted on the main surface of the antenna base between the first and second ends of the antenna base;

a metallic member provided on a side of the second end of the antenna base so as to substantially remove physical influence of the bar antenna on the planar antenna.

2. The complex antenna device according to claim 1, wherein the metallic member includes a metallic rod disposed upright on the main surface of the antenna base.

3. The complex antenna device according to claim 1, further comprising a top case made of resin and covering the bar antenna and the planar antenna in cooperation with the antenna base, wherein the metallic member includes a metallic tape attached onto an inner wall of the top case.

4. The complex antenna device according to claim 1, further comprising a top case made of resin and covering the bar antenna and the planar antenna in cooperation with the antenna base made of metal, wherein the metallic member includes a screw boss of the antenna base disposed upright so as to attach the antenna base to the top case.

5. The complex antenna device according to claim 4, wherein the metallic member further includes a metallic screw penetrating the screw boss.

6. The complex antenna device according to claim 1, wherein the bar antenna is an antenna adapted to receive electric waves of AM/FM radio bands.

7. The complex antenna device according to claim 1, wherein the bar antenna is an antenna adapted to send and receive an electric wave for a car phone.

8. The complex antenna device according to claim 1, wherein the planar antenna severs as an SDARS antenna adapted to receive an electric wave from an SDARS satellite.

9. The complex antenna device according to claim 1, wherein the at least one planar antenna includes a first planar antenna adapted to receive an electric wave from a first satellite, and a second planar antenna adapted to receive an electric wave from a second satellite.

10. The complex antenna device according to claim 9, wherein the first planar antenna is a GPS antenna adapted to receive an electric wave from a GPS satellite as the first satellite and the second planar antenna is an SDARS antenna adapted to receive an electric wave from an SOARS satellite as the second satellite.

11. The complex antenna device according to claim 10, wherein the OPS antenna is provided at a position close to the bar antenna and the SDARS antenna is provided at a position close to the metallic member.

12. A complex antenna device comprising:

an antenna base having a main surface;

at least one planar antenna mounted on the main surface and having a first end and a second end opposed to each other;

a bar antenna made of metal, provided on the main surface, and disposed on a side of the first end; and a metallic member made of metal, provided on the main surface, and disposed on a side of the second end, wherein the at least one planar antenna is positioned between the bar antenna and the metallic member so as to substantially remove physical influence of the bar antenna on the planar antenna.

13. The complex antenna device according to claim 12, wherein the metallic member includes a metallic rod disposed upright on the antenna base.

14. The complex antenna device according to claim 12, wherein the metallic member includes a metallic tape attached onto an inner wall of the antenna device.

* * * * *